US006994591B2

(12) United States Patent
Huang

(10) Patent No.: US 6,994,591 B2
(45) Date of Patent: Feb. 7, 2006

(54) ELECTRICAL CONNECTOR FOR USE WITH FLEXIBLE PRINTED CIRCUIT

(75) Inventor: Chien Hsun Huang, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/914,945

(22) Filed: Aug. 9, 2004

(65) Prior Publication Data

US 2005/0032428 A1 Feb. 10, 2005

(30) Foreign Application Priority Data

Aug. 8, 2003 (TW) ..... 92214449 U

(51) Int. Cl.
*H01R 13/648* (2006.01)

(52) U.S. Cl. ..... 439/607; 439/495

(58) Field of Classification Search ..... 439/607, 439/609, 495, 260

See application file for complete search history.

(56) References Cited

U.S. PATENT DOCUMENTS 6,345,998 B1 * 2/2002 Lee ..... 439/260
6,347,960 B1 * 2/2002 Chen ..... 439/607
6,551,139 B1 * 4/2003 Yu ..... 439/607
6,733,326 B2 * 5/2004 Lee ..... 439/495
6,767,251 B2 * 7/2004 Yu et al. ..... 439/607
6,808,412 B2 * 10/2004 Ishii ..... 439/495
6,821,149 B2 * 11/2004 Lai ..... 439/607
6,884,108 B2 * 4/2005 Saito et al. ..... 439/495
6,902,425 B2 * 6/2005 Huang ..... 439/495
2003/0036309 A1 * 2/2003 Zhang et al. ..... 439/607
2004/0102083 A1 * 5/2004 Kuroda et al. ..... 439/495
2004/0248447 A1 * 12/2004 Aoki ..... 439/260

* cited by examiner

*Primary Examiner*—Michael C. Zarroli
(74) *Attorney, Agent, or Firm*—Wei Te Chung

(57) ABSTRACT

A Flexible Printed Circuit (FPC) connector (1) includes a housing (2), a number of contacts (3,31) received in the housing, an actuator rotatably mounted on the housing, and a shielding (5) attached to the housing. The shielding substantially surrounds a top surface (201) of the housing. A number of securing slots (500) are defined in the shielding and engage with protrusions (202) of the housing for positioning the shielding on the housing. Grounding tabs (501) extend from the shielding for mating with corresponding grounding pads of a PCB. The shielding and the grounding tabs extending therefrom can provide EMI protection to the connector. The shielding can also reinforce the strength of the housing.

12 Claims, 4 Drawing Sheets

ELECTRICAL CONNECTOR FOR USE WITH FLEXIBLE PRINTED CIRCUIT

BACKGROUND OF THE INVENTION

1. Field of the Invention

The present invention relates to electrical connectors, and more particularly to a connector for electrically connecting a flexible substrate such as a flexible printed circuit (FPC), to a circuit substrate such as a printed circuit board (PCB).

2. Description of the Prior Art

Flexible printed circuit (FPC) connectors are widely used for electrically connecting flexible printed circuits to PCBs. A typical FPC connector includes an insulating housing, contact elements received in the housing, an actuator ratatably mounted onto the housing and/or inserted into the housing, for pressing an FPC against the contact elements.

With the miniaturization of electronic system and the development of high-frequency signal transmission technology, A FPC connector used in such system needs to reliably transmit high-frequency signals. A shielding is commonly required to provided for the FPC connector, to prevent Electro Magnetic Interference (EMI) in relation to the external environment. Thus a reliable transmission of high-frequency signals within the system is ensured.

Conventional FPC connectors are disclosed in U.S. Pat. Nos. 5,688,146, 6,276,958 and 6,475,026. These connectors mainly comprise a housing, a plurality of contacts received in the housing, an actuator povotably mounted on the housing, for pressing an FPC against the contacts and solder pads mounted to the housing. However, these connectors have a shortcoming that there is no shielding means in these structures. When transmitting high-frequency signals, these connectors cannot provide effective EMI shielding. This thereby can effect a reliable transmission of the signals.

Therefore, a new flexible printed circuit connector which overcomes the above-mentioned disadvantages of the prior art is desired.

SUMMARY OF THE INVENTION

Accordingly, one object of the present invention is to provide a new FPC connector, whereby the connector can provide Electro Magnetic Interference (EMI) shielding to ensure reliable signal transmission between the FPC connector and a mated connector.

Another object of the present invention is to provide a new FPC connector, whereby the connector can reinforce a housing of the connector.

To achieve the aforementioned objects, an FPC connector in accordance with a preferred embodiment of the present invention is provided. The FPC connector comprises an elongated insulative housing, a plurality of contacts received in the housing and an actuator rotatably mounted to the housing. A shielding is attached to the housing, functioning as an EMI device. The housing has a main body and a pair of side latches extending from two opposite sides of the main body. A plurality of securing protrusions is formed on the main body. A pair of grooves is defined in the main body. The shielding substantially surrounds a top surface of the housing. A plurality of securing slots is defined in the shielding, for engaging with the securing protrusions of the housing. A pair of grounding tabs extends from the shielding, partly retained in the respective grooves of the housing, for mating with corresponding grounding pads of a PCB. A pair of clasping portions is formed on the shielding, surrounding the side latches of the housing. This can also reinforce the strength of the housing.

Other objects, advantages and novel features of the present invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
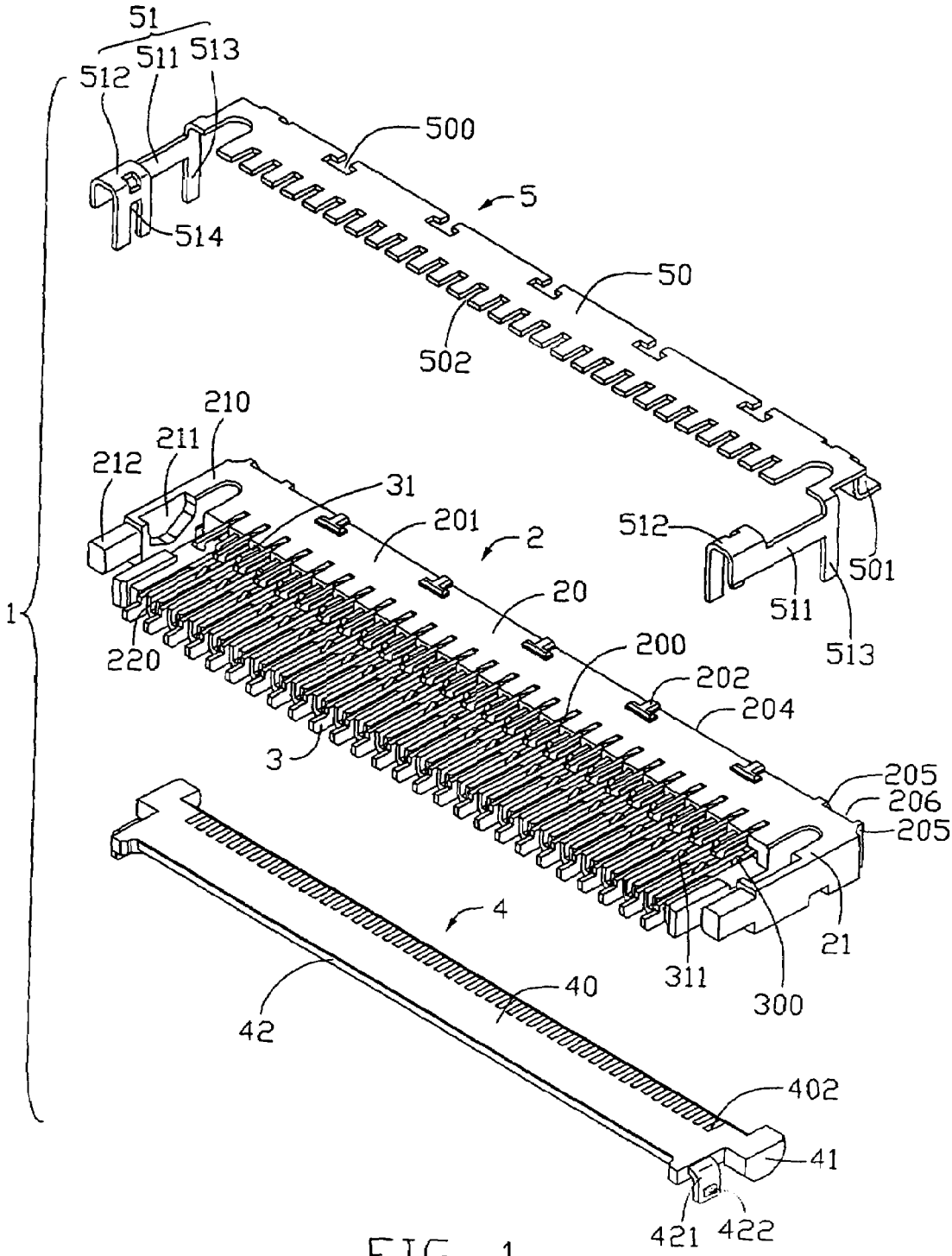
FIG. 1 is an exploded, isometric view of an FPC connector in accordance with a preferred embodiment of the present invention.
Figure 2:
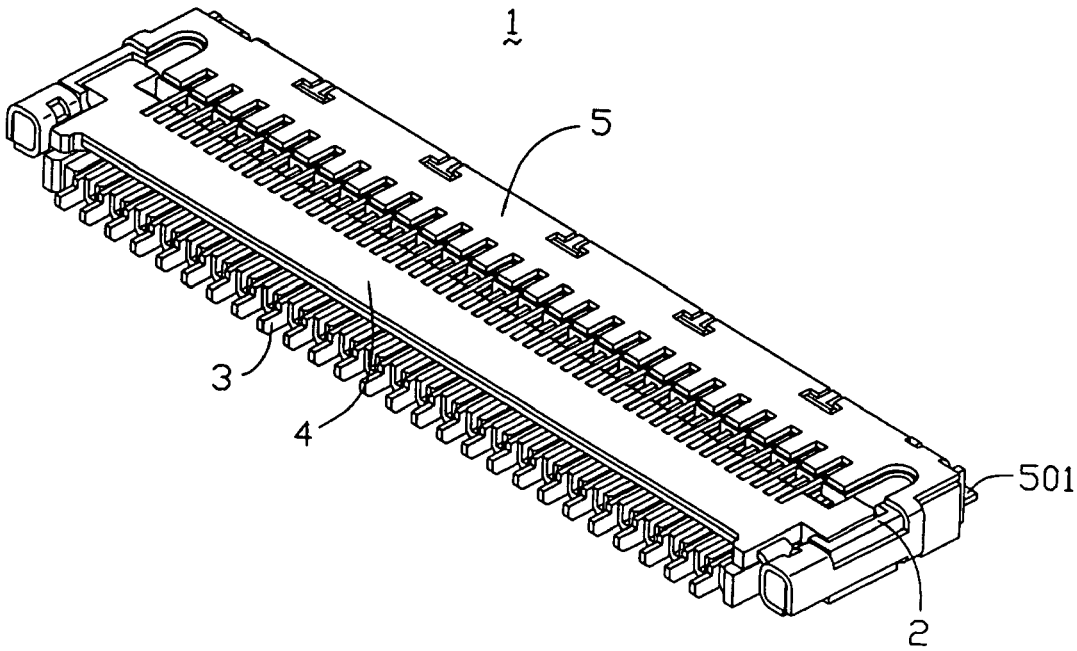
FIG. 2 is an assembled, isometric view of the FPC connector of FIG. 1.
Figure 4:
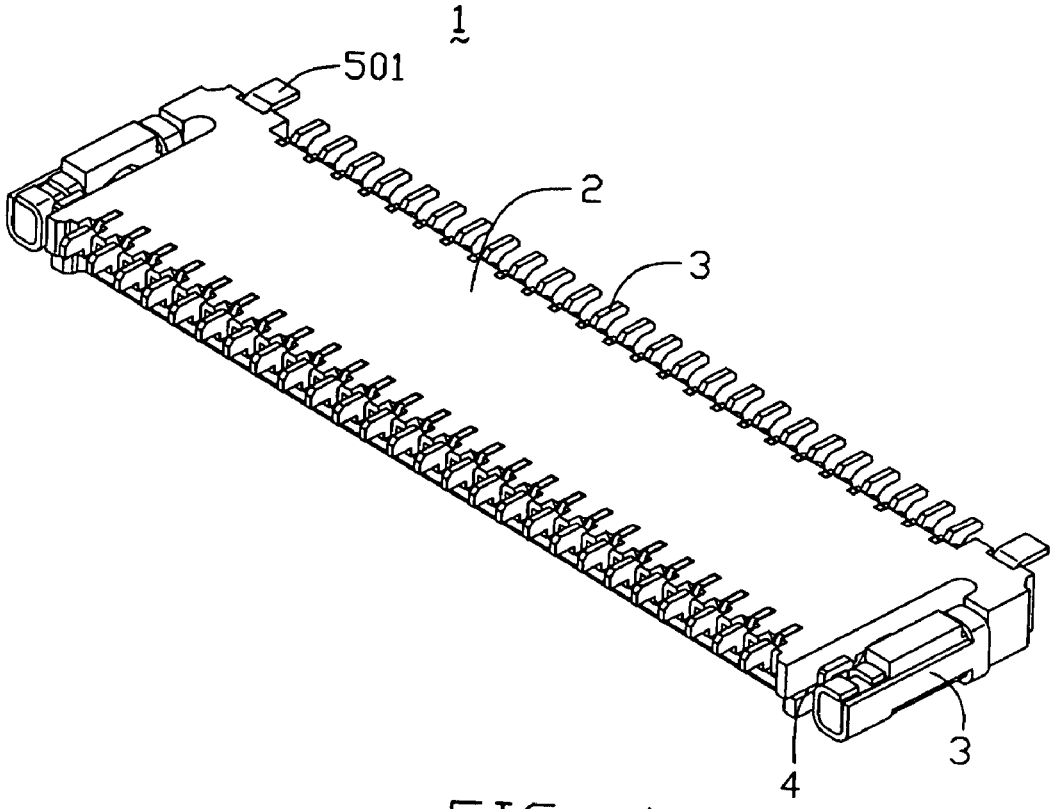
FIG. 4 is an assembled, isometric view of the FPC connector of FIG. 1, but viewed from another aspect.

Referring to FIGS. 1 and 4, an FPC connector 1 in accordance with a preferred embodiment of the present invention is provided for electrically connecting a flexible printed circuit (FPC) (not shown) with a printed circuit board (PCB) (not shown). The FPC connector 1 comprises an insulative housing 2, a plurality of first and second contacts 3,31 received in the housing 2, an actuator 4 rotatably mounted to the housing 2, and a shielding 5 attached to the housing 2.

The housing 2 is configured with a longitudinal main body 21, and a pair of side latches 21 extends from two opposite sides of the main body 21. A plurality of spaced first and second passageways 200,220 are defined in the main body 20, for receiving the corresponding first and second contacts 3, 31 therein, respectively. The main body 20 has a top surface 201, a bottom surface 203 opposite to the top surface 201, and a sidewall 204 connecting the top and the bottom surfaces 201, 203. The bottom surface 203 engages with the PCB, to thereby mount the FPC connector onto the PCB. A plurality of spaced protrusions 202 are formed on a back portion of the top surface 201 and arranged along a longitudinal direction. The protrusions 202 have a substantially "T" shaped configuration. A pair of protrusions 205 is outwardly formed on two opposite end sides of the sidewall 204 respectively. A groove 206 is defined between each pair of protrusions 205 therethrough. The side latches 21 each have a first arm 210 connecting with the main body 20, and a smaller second arm 212 extending forwardly from a front end of the first arm 210. A recess 211 is defined inwardly at one end portion of the first arm 210 near the second arm 212.

Figure 3:
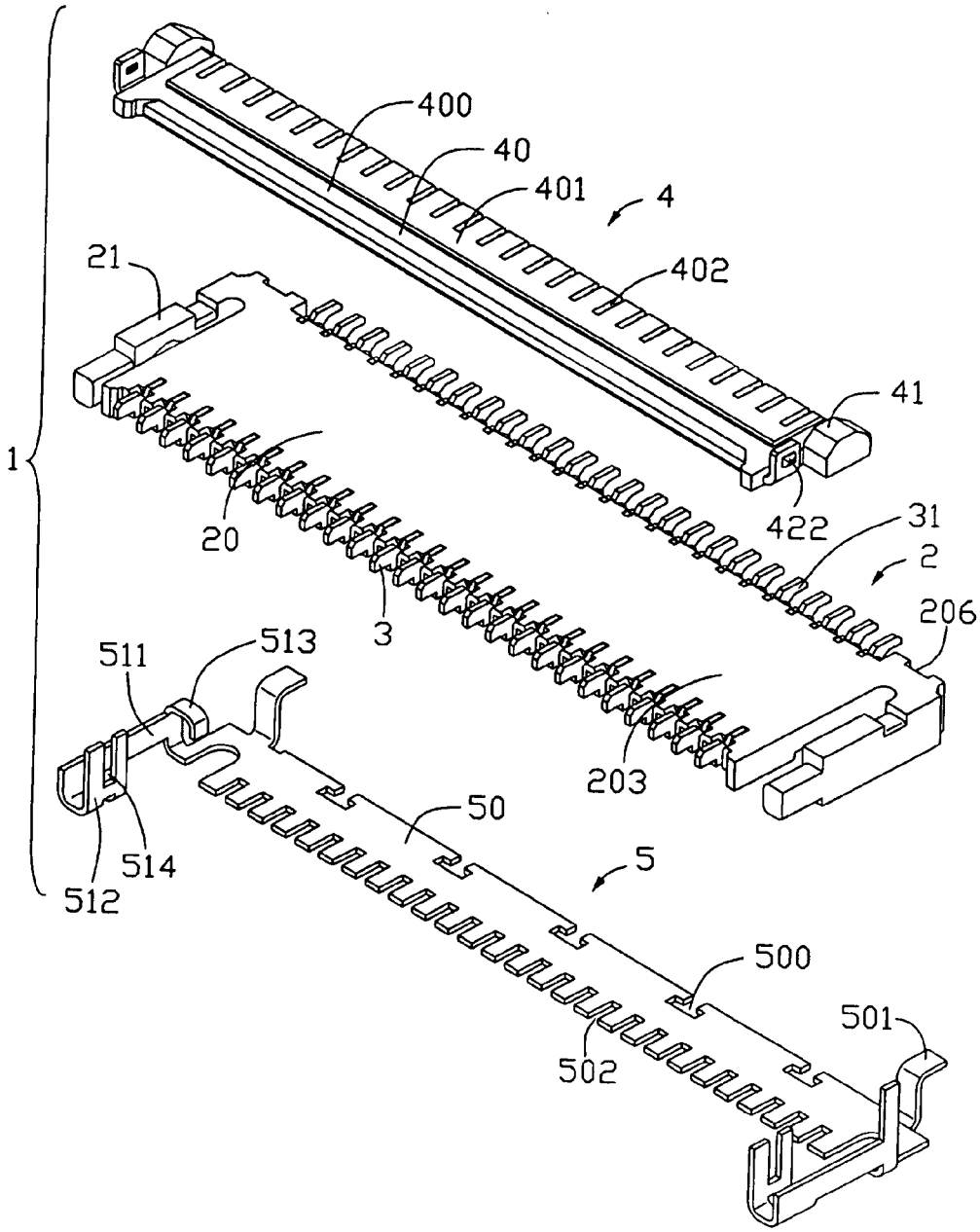
FIG. 3 is an exploded, isometric view of the FPC connector of FIG. 1, but viewed from another aspect.

The actuator 4 comprises a base 40, a pair of latch blocks 41 formed outwardly on two opposite sides of the base 40, and a metal sheet 42 longitudinally inlayed in the base 40, for reinforcing the strength of the base 40. A pressing surface 400 is formed on the base 40 therebottom, for pressing the FPC against the first and second contacts 3,31. A convex 401 is protruded outwardly from the pressing surface 400 (referring to FIG. 3). A plurality of channels 402 is defined in the convex 401, for accommodating the first contacts 3 therein when the actuator 4 being mounted and pressed onto the housing 2. The mental sheet 42 has a main portion (not numbered) and a pair of ears 421 extending and bending downwardly from two opposite sides of the main portion. The main portion is enchased within the base portion 40. A protuberance 422 is formed outwardly on a middle portion of each of the ears 421. The latch blocks 41 are rotatably retained in the recess 211 of the respective side latches 21, and thereby mounting the actuator 4 to the housing 2 pivotably.

The shielding 5 has a planar plate portion 50, and a pair of side clasping portions 51 formed forwardly on two opposite sides of the plate portion 50. A plurality of "T" shaped securing slots 500 is defined in a back portion of the plate portion 50 therethough vertically. The slots 500 engage with the respective protrusions 202 of the housing 2, for positioning the plate portion 50 on the top surface 201 of the housing 2. A pair of grounding tabs 501 extends downwardly from a back longitudinal side of the plate portion 50, partly received in the respective grooves 206 of the housing 2. The grounding tabs 501 each have a cantilever configuration. A mating portion (not numbered) is formed at a free end of the grounding tabs 501 each, for mating with corresponding grounding pads of the PCB. A plurality of indents 502 is defined in a front portion of the plate portion 50, perpendicular to and run through the plate portion 50 vertically. The indents 502 are above on and each communicate with the respective first passageways 200, for avoiding the shielding 5 contacting with the first contacts 3. The clasping portion 51 each have a base portion 511, a clasper 512 formed on the base portion 511 opposite to the plate portion 50, and a strip clip 513 extending from the base portion 511 near the plate portion 50. The clasper 512 extends and bent downwardly from a top edge 32 of the base portion 511. A cutout 514 is defined downwardly in the clasper 512, for engaging with the respective protuberances 422 of mental sheet 42 of the actuator 4.

In assembly, the first and second contacts 3,31 are inserted into and retained in the respective first and second passageways 200,220 of the housing 2. Then the shielding 5 is attached to the housing 2. The protrusions 202 of the housing 2 are locked into the respective slots 500 of the shielding 5, to thereby position the shielding 5 on the top surface 201 of the housing 2. The grounding tabs 501 are partly retained in the corresponding grooves 206 of the housing 2, the mating portion thereof mating with the corresponding grounding pads of the PCB. Thus effective EMI protection is established throughout the connector 1. The clasper 512 and the strip clip 513 of clasping portion 51 embrace the first and second arm 212, 210 of the side latches 21 of the housing 2, respectively. The base portion 511 of the clasping portion 51 abuts against outside wall (not numbered) of the side latch 21. This adversely can reinforce the strength of the side latch 21 of the housing 2. Finally, the latch blocks 41 of the actuator 4 are rotatably inserted into the recess 211 of the side latches 21. Thus, the actuator 4 is mounted to the housing 2 pivotably.

In use, the actuator 4 is rotated to a vertical position. Then the FPC is inserted into an opening (not numbered) of the housing 2 with zero insertion force (ZIF) from a front of the housing, the FPC not engaging with a first and second contacting portions 300,311 of the respective first and second contacts 3, 31. When the FPC is inserted completely into the housing 2, the actuator 4 is rotated down to a horizontal position, where the pressing surface 400 urges the FPC board to engage with the contacts 3, 31. During the rotation, the protuberances 422 of the actuator are locked into the corresponding cutouts 514 of the shielding 5, thereby to hold the actuator 4 at the horizontal position. As a result, the actuator 4 is firmly situated at the horizontal position, and electrical connection between the FPC connector 1 and the FPC is attained.

In the connector 1 of the present invention, the shielding 5 is attached to the housing 2, the slots 500 thereof engaging with the protrusions 202 of the housing 2. The shielding substantially surrounds the housing 2. Thus, EMI protection in housing 2 is established. Additionally, the grounding tabs 501 extend from the shielding 5, partly retained in the grooves 206 of the housing 2. The mating portion of the grounding tabs 501 mates with the corresponding grounding pads of the FPC board. This can reduces the static electricity accumulated in the shielding 5. As a result, complete EMI protection throughout the connector 1 is provided. Furthermore, The plate portion 50 of the shielding 5 covers the main body 20 of the housing 2, and the clasping portion 51 embrace the side latches of the housing. This can prevent the housing 2 from damage caused by external forces, and thereby to reinforce the strength of the housing.

While the present invention has been described with reference to a preferred embodiment, the description is illustrative and is not to be construed as limiting the invention. Therefore, various equivalent modifications and changes known to persons skilled in the art according to the spirit of the present invention are considered within the scope of the present invention as defined in the appended claims.

What is claimed is:

1. An electrical connector assembly comprising:

a printed circuit board (PCB);

a flexible substrate;

an insulative housing having a plurality of protrusions;

a plurality of contacts received in the housing; and a shielding attached to the housing, the shielding including a plurality of securing slots and a pair of grounding tabs, the protrusions of the housing engaging with the securing slots closely, for positioning the shielding on the housing, the grounding tabs mating with corresponding grounding pads of the PCB; wherein the securing slots of the shielding and the protrusions of the housing have a substantially "T" shaped configuration; wherein the shielding comprises a plate portion and a plurality of spaced indents defined on the plate portion, the grounding tabs extending from a longitudinal side of the plate portion.

2. The electrical connector assembly as claimed in claim 1, wherein the housing comprises a main body and a pair of side latches extending from two opposite sides of the main body.

3. The electrical connector assembly as claimed in claim 2, wherein the protrusions are formed on a top surface of the main body.

4. The electrical connector assembly as claimed in claim 3, wherein a pair of grooves is defined on a sidewall of the main body, the grounding tabs partly retained in the respective grooves.

5. The electrical connector assembly as claimed in claim 4, wherein the shielding comprises a pair of clasping portions extending from two opposite sides of the plate portion, the clasping portions surrounding the respective side latches of the housing.

6. The electrical connector assembly as claimed in claim 5, wherein the clasping portions each have a base portion, a clasper extending from the base portion opposite to the plate portion, and a clip extending from the base portion near the plate portion.

7. The electrical connector assembly as claimed in claim 6, further comprises an actuator mounted on the housing, the actuator comprising a base, a pair of latch blocks formed outwardly on two opposite sides of the base, and a metal sheet longitudinally inlayed in the housing, a pair of ears extending beyond the plate portion from the metal sheet, a locking protuberance formed on a middle portion of each of the ears.

8. The electrical connector assembly as claimed in claim 7, the clasper of the clasping portions defines a cutout, the protuberance of the actuator locked in the cutout.

9. An electrical connector assembly comprising:

an insulative housing having a top surface and a sidewall, a plurality of protrusions formed on the top surface;

a plurality of contact elements received in the housing; and an outer shielding attached to the housing, the shielding has a plurality of securing slots and a pair of grounding tabs, the protrusions of the housing engaging with the respective slots closely, for positioning the shielding on the top surface of the housing, the grounding tabs extending from the shielding, a pair of grooves defined on the sidewall of the housing, the grounding tabs partly retained in the grooves, respectively, and mating with corresponding grounding pads of a PCB; wherein the securing slots of the shielding and the protrusions of the housing have a substantially "T" shaped configuration; wherein the shielding comprises a longitudinal plate portion and a plurality of spaced indents defined on the plate portion, the grounding tabs extending from a longitudinal side of the plate portion; wherein the housing comprises a main body and a pair of side latches extending from two opposite sides of the main body; wherein the shielding comprises a pair of clasping portions extending from two opposite sides of the plate portion, the clasping portion surrounding the respective side latches of the housing.

10. The electrical connector assembly as claimed in claim 9, wherein the clasping portions each have a base portion, a clasper extending from the base portion opposite to the plate portion, and a clip extending from the base portion near the plate portion.

11. The electrical connector assembly as claimed in claim 10, further comprises an actuator mounted on the housing, the actuator comprising a base, a pair of latch blocks formed outwardly on two opposite sides of the base, and a metal sheet longitudinally inlayed in the housing, a pair of ears extends beyond the plate portion from the metal sheet, a locking protuberance formed on a middle portion of each of the ears.

12. The electrical connector assembly as claimed in claim 11, wherein the clasper of the clasping portions defines a cutout, the protuberance of the actuator locked in the cutout.

* * * * *